US007758237B2

(12) United States Patent
Musy et al.

(10) Patent No.: US 7,758,237 B2
(45) Date of Patent: Jul. 20, 2010

(54) SPIRAL/COLLET ASSEMBLY FOR A HOROLOGICAL MOVEMENT

(75) Inventors: Jean-Pierre Musy, Begnins (CH); Frédéric Maier, Neuchâtel (CH); Stéphane Von Gunten, La Chaux-de-Fonds (CH)

(73) Assignee: Patek Philippe SA Geneve, Geneva (CH)

( * ) Notice: Subject to any disclaimer, the term of this patent is extended or adjusted under 35 U.S.C. 154(b) by 0 days.

(21) Appl. No.: 12/085,663

(22) PCT Filed: Apr. 26, 2007

(86) PCT No.: PCT/IB2007/001083

§ 371 (c)(1),
(2), (4) Date: May 29, 2008

(87) PCT Pub. No.: WO2007/132306

PCT Pub. Date: Nov. 22, 2007

(65) Prior Publication Data

US 2009/0135679 A1 May 28, 2009

(30) Foreign Application Priority Data

May 17, 2006 (EP) ..... 06010169

(51) Int. Cl.
*G04B 17/06* (2006.01)

(52) U.S. Cl. ..... 368/177; 368/175

(58) Field of Classification Search ..... 368/177, 368/175

See application file for complete search history.

(56) References Cited

U.S. PATENT DOCUMENTS

2006/0055097 A1 3/2006 Conus et al.

FOREIGN PATENT DOCUMENTS

| | | | |
|---|---|---|---|
| CH | 500 523 | | 8/1970 |
| CH | 508233 | * | 7/1971 |
| EP | 1 445 670 A1 | | 8/2004 |
| EP | 1 637 940 A2 | | 3/2006 |

* cited by examiner

*Primary Examiner*—Vit W Miska
*Assistant Examiner*—Jason Collins
(74) *Attorney, Agent, or Firm*—Bacon & Thomas, PLLC

(57) ABSTRACT

A balance spring-collet assembly for a timepiece movement comprises a collet (1) and a balance spring (3) attached at its inner end to the collet (1). The collet (1) is capable of being mounted onto a shaft (2). The external periphery of the collet (1) defines abutments (10*a*, 10*b*, 10*c*) against which the inner turn of the balance spring (3) may come to rest during a shock before the elastic limit of the inner turn is exceeded. The abutments (10*a*, 10*b*, 10*c*) are situated at respective distances (Ra, Rb, Rc) from the center (O) of the shaft (2) that increase in the direction (D) of the balance spring (3) from the inside to the outside starting at the point (8) of junction between the balance spring (3) and the collet (1).

14 Claims, 3 Drawing Sheets

SPIRAL/COLLET ASSEMBLY FOR A HOROLOGICAL MOVEMENT

The present invention concerns a balance spring-collet assembly for a timepiece movement, and more precisely a balance spring the inner end of which is attached to a collet that may be driven onto the shaft of a balance so as to form the regulating device of the movement.

It is known that when a watch is subjected to a shock, the balance spring of the regulating device may be deformed beyond its elastic limit, and thus may undergo a permanent deformation harmful to its operation, or may even break if the material of which it consists is a fragile material such as silicon.

The patent CH 500 523 describes a collet comprising at its periphery three abutments against which the inner turn of the balance spring can come to rest in case of a radial shock to limit the deformation of the balance spring. These three abutments are equidistant from the center of the balance shaft. One of these abutments is, therefore, necessarily nearer to the inner turn than the other two. Such an arrangement may be a problem in the sense that the nearest abutment may be touched by the inner turn during normal operation of the movement, which may perturb the said operation, especially if the amplitude of the oscillations of the balance is large, and/or that the farthest abutment may be too far for, in case of a shock, serving as a rest surface to the inner turn before the elastic limit of this latter is exceeded.

The present invention aims at remedying the above-mentioned drawbacks of the prior art and, to this end, provides a balance spring-collet assembly according to the appended claim 1, i.e. a balance spring-collet assembly comprising a collet and a balance spring attached at its inner end to the collet, the collet being adapted for mounting on a shaft, the external periphery of the collet defining abutments against which the inner turn of the balance spring may come to rest during a shock before the elastic limit of the inner turn is exceeded, characterized in that said abutments are situated at respective distances from the center of the shaft that increase in the direction of the balance spring from the inside to the outside starting at the point of junction between the balance spring and the collet.

Particular embodiments of this balance spring-collet assembly are defined in the appended dependent claims 2 to 13.

The present invention also proposes a timepiece movement comprising this balance spring-collet assembly.

Further characteristics and advantages of the present invention will become apparent from a reading of the following detailed description given while referring to the annexed drawings in which.

Figure 1:
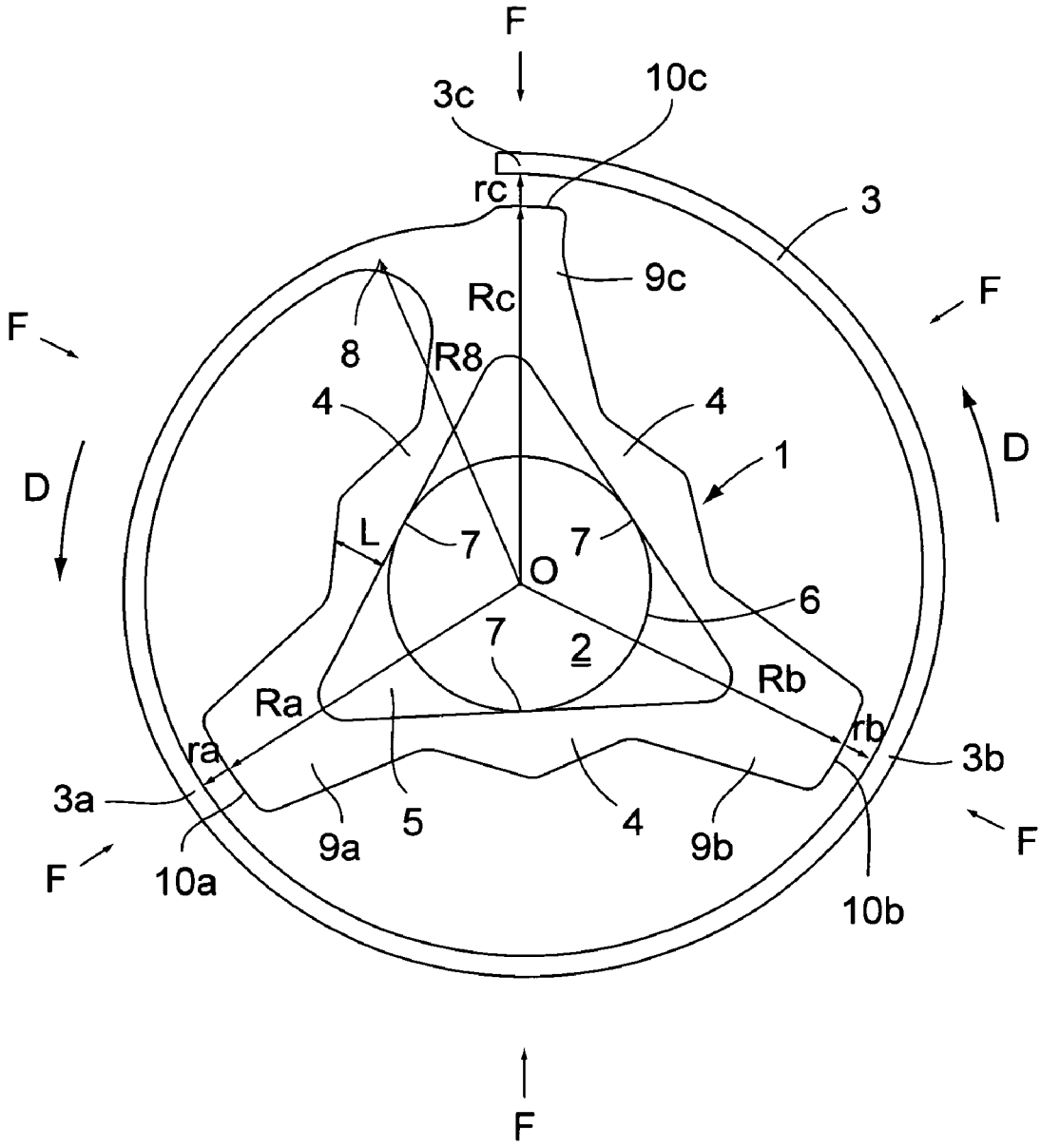
FIG. 1 shows a balance spring-collet assembly according to the invention in its rest position.
Figure 2:
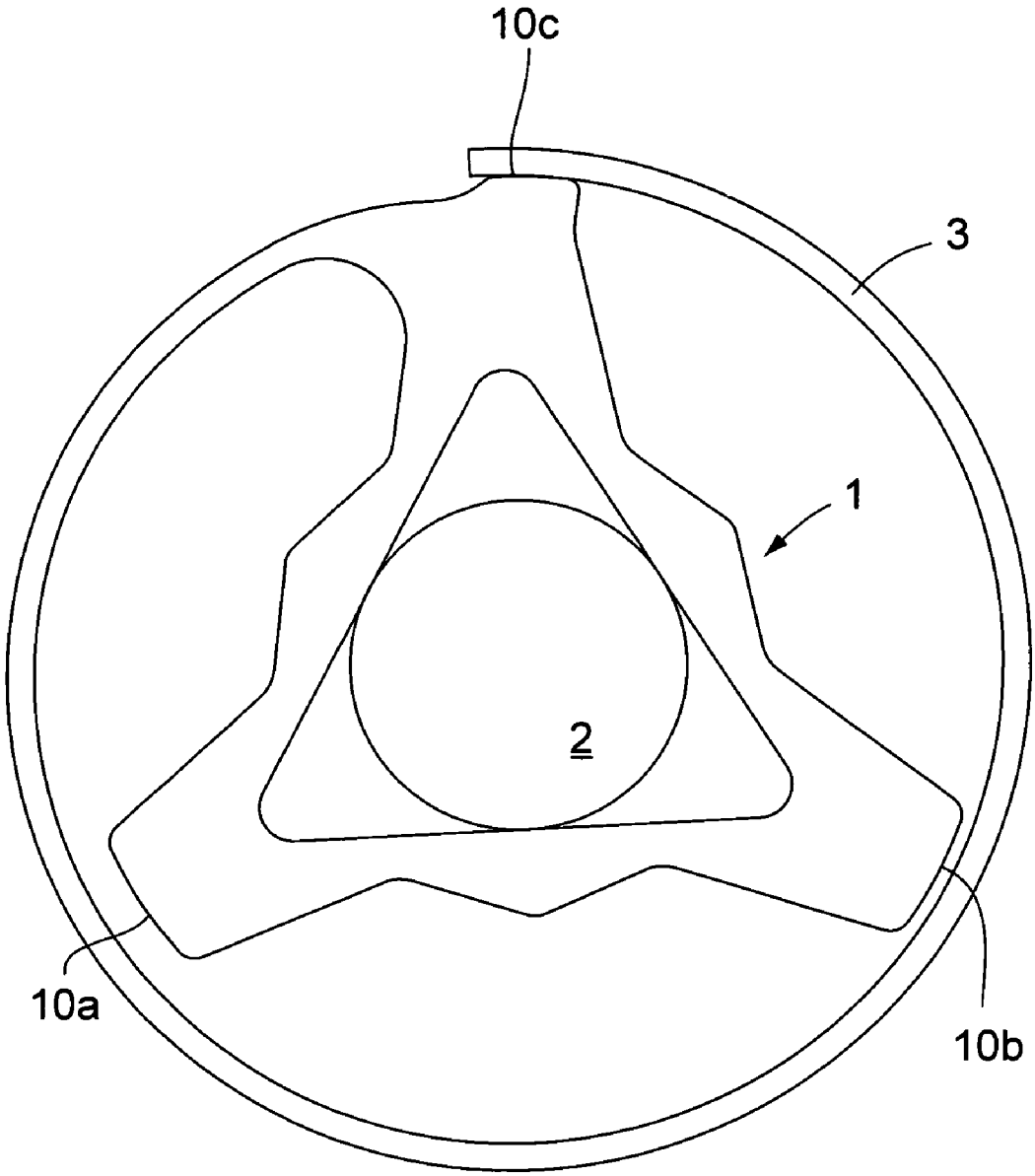
FIG. 2 shows the balance spring-collet assembly of FIG. 1 during a shock.

Referring to FIGS. 1 and 2, a balance spring-collet assembly for a timepiece movement according to a first embodiment of the invention comprises a collet 1 intended to be mounted onto a balance shaft 2, and a balance spring 3 attached at its inner end to collet 1. In the figures, balance spring 3 is represented partially, only its inner turn being visible.

Collet 1 includes three elastic arms 4 in a triangular arrangement. The elastic arms 4 define a central equilateral triangular opening 5 the inscribed circle of which has a slightly smaller diameter than the diameter of a cylindrical or slightly conical contact surface 6 of shaft 2, such that shaft 2 may be driven into collet 1, this driving elastically deforming arms 4 outwardly. By virtue of its triangular shape, the periphery of opening 5 defines three discrete points 7 of contact with shaft 2. Width L of each of the arms 4 is variable in the manner of the elastic arms of the collet of document EP 1,637,940 so as to produce a more uniform distribution of the stresses exerted in a given arm 4 by shaft 2.

The point 8 of junction between balance spring 3 and collet 1 is defined by one 9*c* of the three zones 9*a*, 9*b*, 9*c* of junction between arms 4. Since collet 1 is driven onto shaft 2, the inner end of balance spring 3 is rigidly connected with shaft 2 and thus follows the oscillating movements of the balance. The outer end of balance spring 3 (not shown) is fixed in known manner to a fixed part of the movement, typically the cock, by a stud.

Collet 1 preferably is of one-piece construction with balance spring 3. The balance spring-collet assembly 1, 3 typically is made of a fragile material, that is, a material that cannot undergo plastic deformation, such as a material based on silicon, glass, quartz, or diamond. Notably in the case of silicon, a proper manufacturing process for the balance spring-collet assembly 1, 3 is the DRIE (deep reactive-ion etching) process. In a variant, however, the balance spring-collet assembly 1, 3 may be made of a ductile material such as a metallic material.

According to the invention, discrete segments 10*a*, 10*b*, and 10*c* of the external periphery of collet 1 constitute abutments against which the inner turn of balance spring 3 may come to rest during a shock undergone by the movement. These abutments 10*a*, 10*b*, and 10*c* are defined by the zones 9*a*, 9*b*, and 9*c* of junction of the elastic arms 4, and thus are arranged in a substantially regular angular distribution. These abutments 10*a*, 10*b*, and 10*c* are at distances Ra, Rb, and Rc, respectively, from the center O of shaft 2 in the plane of collet 1, and more precisely have the shape of circular arcs with center O and radii Ra, Rb, and Rc, respectively. The distances or radii Ra, Rb, and Rc are selected small enough so that balance spring 3 is not disturbed by abutments 10*a*, 10*b*, and 10*c* during the normal oscillations of the balance, but large enough so that during a shock undergone by the movement, the inner turn of balance spring 3 can come to rest against one or several of the abutments 10*a*, 10*b*, and 10*c* before the elastic limit of this inner turn, at any point of this turn including the junction point 8, is exceeded (FIG. 2). When the inner turn is resting against one or several of the abutments 10*a*, 10*b*, and 10*c* under the effect of a shock, any of the other turns may come to rest against the turn that precedes it. In this way the risk is reduced that balance spring 3 may be damaged by breaking when it is made of a fragile material, or by a permanent deformation when it is made of a ductile material.

Advantageously, starting at the point 8 of junction between balance spring 3 and collet 1, the distances or radii Ra, Rb, and Rc increase in the direction D of winding of balance spring 3 from the inside to the outside, so as to take into account the fact that the radius of the inner turn of balance spring 3, like that of all other turns, increases in this direction D. Thus, abutment 10*a* nearest to the junction point 8 in direction D is at a distance Ra from the center O that is smaller than distance Rb between the next abutment 10*b* and center O, which in turn is smaller than the distance Rc between the next abutment 10*c* and center O. Distance R8 from point 8 of junction between balance spring 3 and collet 1 to center O typically is larger than, or the same as, distance Ra, but smaller than distances Rb and Rc.

These distances Ra, Rb, and Rc are determined by defining a certain number of radial forces F oriented toward center O, by calculating, by the method of finite elements for example, the maximum elastic deformation that the inner turn may undergo under the action of each of the radial forces F, and by selecting distances Ra, Rb, and Rc large enough so that this maximum elastic deformation can not be attained, or can at least not be exceeded, but small enough so that balance spring 3 does not touch abutments 10*a*, 10*b*, and 10*c* during its normal operation.

The deformation of the inner turn of balance spring 3 at each of points 3*a*, 3*b*, and 3*c* facing the abutments 10*a*, 10*b*, and 10*c*, respectively, in the configuration where such a point rests against the corresponding abutment 10*a*, 10*b*, or 10*c*, respectively, under the action of a radial force F exerted at this point, is thus a percentage smaller than or equal to 100% of the maximum elastic deformation that the inner turn is able to undergo at that point. This confers a safety factor (ratio between the maximum elastic deformation and the elastic deformation when the inner turn is resting against an abutment 10*a*, 10*b* or 10*c*) of more than one or of one. The said percentage preferably is substantially the same for all abutments 10*a*, 10*b*, 10*c*. In an exemplary realization of the invention, said percentage is about 50% (safety factor of about two), while the percentage of deformation of the inner turn during normal operation of the balance spring relative to the maximum elastic deformation of said inner turn is about 25%, for a pitch of balance spring 3 of about 93 μm and a thickness or width of the turns of balance spring 3 of about 30 μm.

In a simplified variant of realization based on a linear approximation of the inner turn's deformation as a function of position on this turn, distances Ra, Rb, and Rc are a same percentage, respectively, of the corresponding radii ra, rb, and rc of the inner turn at rest, i.e of the distances between points 3*a*, 3*b*, 3*c* and the center O. For a pitch of balance spring 3 of about 93 μm and a thickness or width of the turns of balance spring 3 of about 30 μm, said percentage is for instance about 90%.

It can thus be seen that, by virtue of the fact that distances Ra, Rb and Rc increase in direction D starting from junction point 8, the safety factors for abutments 10*a*, 10*b* and 10*c* may be identical or may at least be near one another. Collet 1 will therefore be able to protect balance spring 3 in the event of a radial shock in a reliable manner, irrespective of the direction of said shock, without perturbing the normal operation of the regulating device formed by the balance and balance spring, even if the amplitude of the oscillations of the balance is large.

Figure 3:
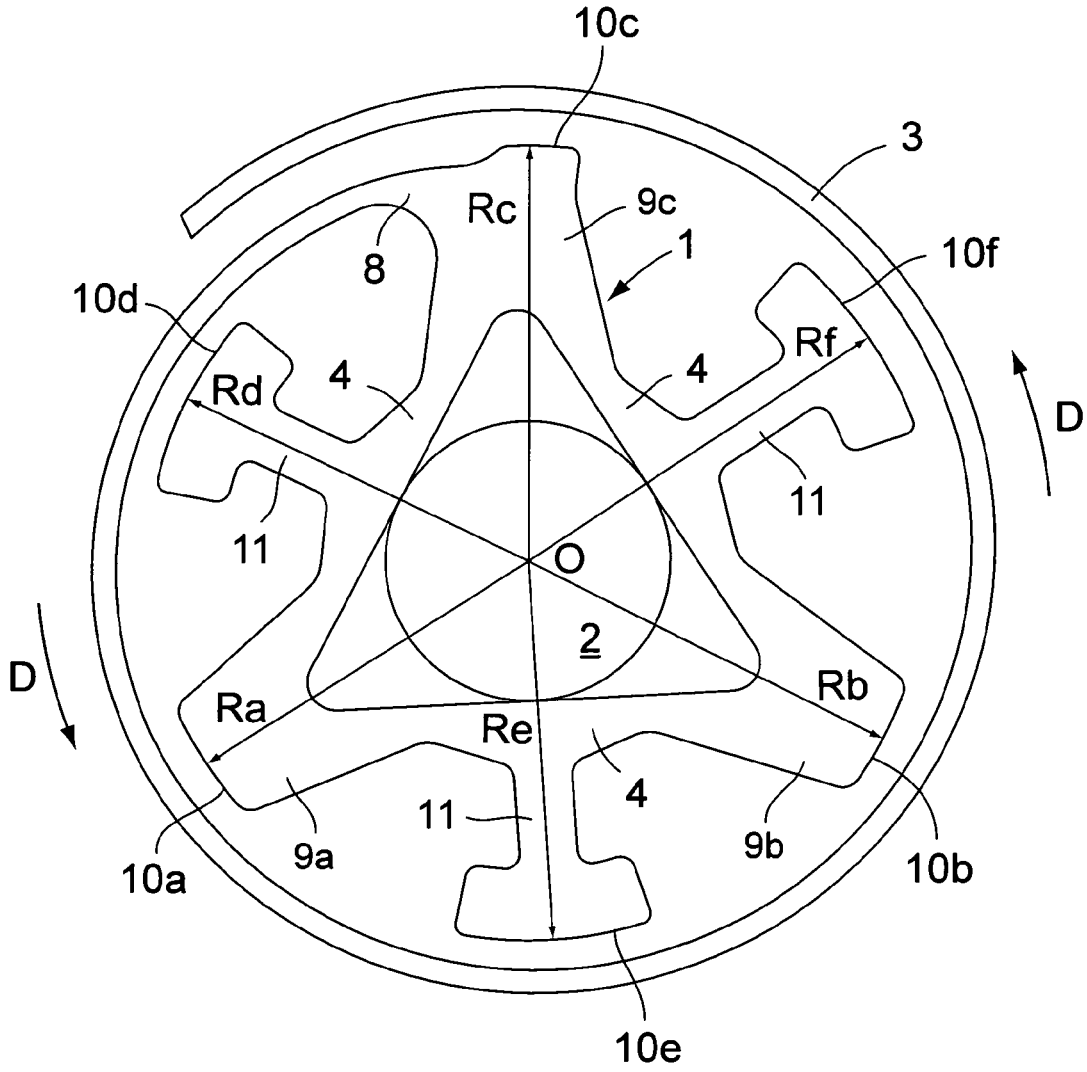
FIG. 3 shows a balance spring-collet assembly according to another embodiment of the invention in its rest position.

FIG. 3 shows another embodiment of the invention where collet 1 includes, in addition to abutments 10*a*, 10*b*, 10*c* defined by the zones 9*a*, 9*b*, 9*c* of junction between arms 4, abutments 10*d*, 10*e*, 10*f* defined by elements 11 radially projecting from the outer side of arms 4 in the central region of said arms 4 in contact with shaft 2. Like abutments 10*a*, 10*b*, 10*c*, said abutments 10*d*, 10*e*, 10*f* are circular arcs with centers at center O of shaft 2. The respective distances Ra to Rf between abutments 10*a* to 10*f* and center O increase in the direction D of the balance spring from the inside to the outside starting at point 8 of junction between balance spring 8 and collet 1, in other words, Rd<Ra<Re<Rb<Rf<Rc.

The present invention is in no way limited to the embodiments described above. It is evident in fact that modifications could be made without leaving the scope of the invention claimed. For instance, opening 5 of collet 1 into which shaft 2 is driven could have a shape other than triangular, such as another polygonal shape, regular or irregular, defined by a number of elastic arms of more than three. In another variant, the collet could take the shape of a split ring having radial projections defining the abutments. In still another variant, the abutments could be contiguous rather than discrete, more particularly, a large continuous segment of the collet's external periphery could serve as the abutment. The external periphery then would have a shape similar to that of the inner turn, that is, a radius that increases in the winding direction D of the balance spring from the inside to the outside starting at the point of junction between the balance spring and the collet. In this case the external periphery could be defined by a frame surrounding the elastic arms or it could be the external periphery of a "full" collet without elasticity cutouts.

The invention claimed is:

1. Balance spring-collet assembly for a timepiece movement, comprising a collet and a balance spring having an inner turn and being attached at its inner end to the collet, the attachment defining a point of junction between the balance spring and the collet, the collet being adapted for mounting on a shaft, an external periphery of the collet defining abutments against which the inner turn of the balance spring may come to rest during a shock before the elastic limit of the inner turn is exceeded, wherein said abutments are situated at respective distances from a center of a shaft on which the collet is adapted to be mounted that increase along a direction of the balance spring from its inner end to its outer end starting at said point of junction.

2. Balance spring-collet assembly according to claim 1, wherein the abutments are spaced from the balance spring so as not to be touched by the balance spring during the normal operation of said spring.

3. Balance spring-collet assembly according to claim 1, wherein the abutments are defined by discrete segments of an external periphery of the collet.

4. Balance spring-collet assembly according to claim 3, wherein the number of said abutments is at least three.

5. Balance spring-collet assembly according to claim 3, wherein the abutments are arranged according to a substantially regular angular distribution.

6. Balance spring-collet assembly according to claim 3, wherein the abutments comprise substantially circular arcs having as their center a center of a shaft to which the collet is adapted to be mounted.

7. Balance spring-collet assembly according to claim 3, wherein the collet comprises elastic arms arranged as a polygon between which a shaft is engageable, and at least one of said abutments is situated at a zone of junction between two of said elastic arms.

8. Balance spring-collet assembly according to claim 3, wherein the collet comprises elastic arms arranged as a polygon between which a shaft is engageable, and at least one of said abutments is defined by an element projecting from an outer side of one of said elastic arms.

9. Balance spring-collet assembly according to claim 1, wherein each of said distances is selected in such a way that in a configuration where a point of the inner turn of the balance spring is resting against a corresponding abutment under the action of a radial force oriented toward a center of a shaft to which the collet is attachable and exerted at said point, the deformation of the inner turn of the balance spring at said point is a certain percentage of the maximum elastic deformation that the inner turn may undergo at said point, said percentage being substantially the same for all of said distances.

10. Balance spring-collet assembly according to claim 1, wherein each of said distances is a percentage of the radius of the inner turn of the balance spring at rest at a point of said inner turn facing a corresponding abutment, said percentage being substantially the same for all of said distances.

11. Balance spring-collet assembly according to claim 1, said assembly being constituted of a single piece.

12. Balance spring-collet assembly according to claim 1, said assembly being constituted of a material that is not capable of plastic deformation.

13. Balance spring-collet assembly according to claim 12, wherein said assembly is constituted of a silicon-based material.

14. Timepiece movement comprising a balance spring-collet assembly according to claim 1.

* * * * *